United States Patent [19]

Gustafsson et al.

[11] 4,099,914

[45] Jul. 11, 1978

[54] METHOD AND AN ARRANGEMENT FOR THE STERILIZATION OF PACKING MATERIAL

[75] Inventors: Åke Gustafsson, Chatel-Saint-Denis, Switzerland; Olof Stark, Rydsgård, Sweden

[73] Assignee: AB Ziristor, Lund, Sweden

[21] Appl. No.: 744,604

[22] Filed: Nov. 24, 1976

[30] Foreign Application Priority Data

Nov. 28, 1975 [SE] Sweden ..... 7513420

[51] Int. Cl.[2] ..... A61L 1/00; A61L 13/00; B65B 31/02; B65B 55/10

[52] U.S. Cl. ..... 21/57; 21/58; 21/78; 21/93; 21/119; 53/21 FC; 53/111 RC; 53/167

[58] Field of Search ..... 21/58, 78, 57, 92, 93, 21/117, 119; 53/21 FC, 111 RC, 167

[56] References Cited

U.S. PATENT DOCUMENTS

| | | | |
|---|---|---|---|
| 3,139,323 | 6/1964 | Shields et al. | 21/57 |
| 3,383,831 | 5/1968 | Goldsmith et al. | 21/58 |
| 3,440,003 | 4/1969 | Tuma | 53/167 |
| 3,466,841 | 9/1969 | Rausing | 21/78 |
| 3,692,468 | 9/1972 | Loliger et al. | 21/92 |
| 3,854,874 | 12/1974 | Loliger et al. | 21/93 |

*Primary Examiner*—Morris O. Wolk
*Assistant Examiner*—Bradley R. Garris
*Attorney, Agent, or Firm*—Earle R. Marden; H. William Petry

[57] ABSTRACT

Method and apparatus to internally sterilize a tube of packing material in which a sterile product is being introduced. The sterilizing agent is introduced into the tube in liquid form wherein it is vaporized. When it is vaporized, it rises upwardly in the tube of packing material and condenses on the interior surface of the tube of material.

9 Claims, 1 Drawing Figure

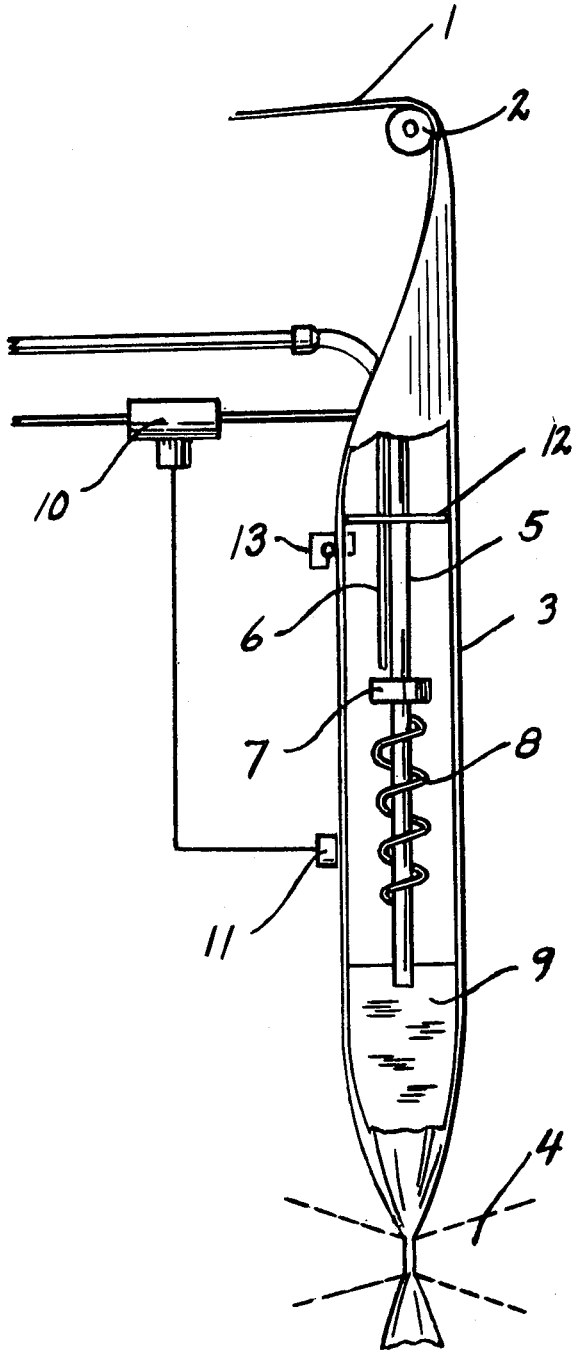
1
2
10
12
13
5
6
3
7
8
11
9
4

METHOD AND AN ARRANGEMENT FOR THE STERILIZATION OF PACKING MATERIAL

The present invention relates to a method for the internal sterilization of a tube of packing material, which tube, after sterilization, is to be filled with sterile contents and is to be divided up into individual packing units containing the sterile contents by repeated pressing flat and sealing along narrow zones which extend transversely across the tube and are situated at a distance from one another.

The invention also relates to an arrangement for the realization of the method.

A frequently occurring consumer package of the disposable type for beverages, e.g. milk, is manufactured in that packing material, which e.g. may consist of a laminate comprising a carrier layer of fibrous material, which is covered on both sides with thin plastic layers, is fed to a packing machine in the form of a web. During the feed through the packing machine, the material web is folded to tubular shape, in that its two longitudinal edges are made somewhat to overlap one another and are sealed to one another. This transformation of the packing material web takes place continuously during the feed of the material web, essentially vertically downwards, through the machine. After transformation to tubular form, the contents are supplied continuously to the tube by means of a filling pipe which extends into the tube through the upper open end of the same. As the tube advances downwards, sealing jaws arranged on both sides of the tube press the same flat and seal it along narrow zones which are situated at a distance from one another and which extend transversely across the tube. The supply of the contents is controlled the whole time automatically in such a manner that the level of the contents is well above the point at which the pressing flat and sealing of the tube take place. After sealing and possibly shaping, the tube is cut by means of transverse cuts in the sealing zones, whereupon the manufacture of the filled, separate packing units is completed.

It is possible in the type of packing machine described to manufacture sterile packages. The filling is carried out then under aseptic conditions, which means that the atmosphere in the material tube, as well as the material tube itself (or in any case the inside of the same), have to be kept sterile. To achieve the firstnamed condition, a certain pressure of sterile air is maintained inside the packing material tube so that no non-sterile air can enter from the surrounding atmosphere. The sterilization of the packing material web is achieved prior to transformation to tubular shape passing through a bath of chemical sterilizing agent, usually hydrogen peroxide solution, which is made to moisten the packing material whereupon the excess liquid is removed from the packing material by means of calender rolls. The portion of sterilizing agent which remains on the packing material web is removed, after the transformation of the material web to a tube, from the tube's inside by means of a heating arrangement, usually a heating coil arranged around the filling pipe, a so-called tube heater, which heats the inside of the packing material tube and the residues of sterilizing agent remaining thereon to such an extent that the agent is evaporated and escapes from the upper, open end of the packing material tube.

This method of sterilization, by and large, functions well, but is subject to certain disadvantages. Thus it has been found difficult under certain conditions to control the quantity of sterilizing agent on the material web, since the calender rolls used for the purpose provide a metering that is difficult to check. To ensure an even application of sterilizing agent on the web, and hence an effective sterilization, the sterilizing agent has to contain stabilizers and wetting agents, which substances are difficult to remove completely and are moreover undesirable for reasons of cost. A further disadvantage of the arrangement used up to now is that the container for sterilizing fluid, the calender rolls and the further guide rolls which are made necessary, require a considerable amount of space.

It is an object of the present invention to provide a method and an arrangement for the sterilizing of a packing material web on the abovementioned type of packing machines.

It is a further object of the present invention to provide a method and an arrangement for the sterilizing of a packing material web which method and which arrangement are not subject to the abovementioned disadvantages, but make possible a simple and safe sterilization with a minimum consumption of sterilizing agent.

This object has been achieved in accordance with the invention by giving a method of the type described in the beginning the characteristic that a sterilizing agent in liquid form is supplied to the tube, that the sterilizing agent is made to evaporate inside the tube and that the vapour formed is made to condense on the inside of the tube to form a uniform layer of condensate containing sterilizing agent.

An arrangement for the realization of the method in accordance with the invention is given the characteristic, that it comprises a heatable container, an elongated heat-radiating element, and an arrangement for the metering of the supply of liquid to the container, with the heat-radiating element being arranged concentrically to the tube, below the container, seen in the direction of movement of the tube.

Preferred embodiments of the method as well as of the arrangement have been given the characteristics which are evident from the subsidiary claims.

The invention will be described in detail in the following with reference to the enclosed schematic drawing, which shows an arrangement in accordance with the invention.

In the FIGURE, which merely reveals the details necessary for an understanding of the invention, a packing material web is indicated by reference numeral 1. The packing material web 1 comprises a central carrier layer of fibrous material, which is covered with layers of aluminium foil and thermoplastic material. A guide roll for the packing material web 1 is indicated by reference numeral 2 and a part of the packing material web transformed to a tube has been indicated by 3. A sealing arrangement 13 heats and presses together the longitudinal edges of the material web so as to form a longitudinal joint on the tube 3. At the bottom end of the tube 3 sealing jaws 4 are indicated. Inside the tube 3, the wall of which for the sake of clarity has been partly removed, there is a delivery pipe 5 for the contents, which extends through the upper, open end of the tube. Furthermore, there is a delivery pipe 6 for sterilizing fluid, which pipe extends parallel with the filling pipe and terminates in an annular dish 7 arranged around the filling pipe. Underneath the dish the filling pipe 5 is surrounded by a heating arrangement or tube heater 8, which extends helically around the pipe 5. The filling pipe 5 terminates in the packing material tube 3 at some distance above the sealing jaws 4. The lower end of the tube 3 is filled with sterile contents 9. The delivery pipe 6 for the sterilizing agent, which in conformity with the contents pipe 5 extends through the upper, open end of the tube 3, is provided outside the tube 3 with a control valve 10. The control valve is actuated by means of a temperature scanning element or a probe 11. The delivery pipe 5 for the contents as well as the delivery pipe 6 for the sterilizing agent extend to reservoirs (not shown) for the contents and the sterilizing fluid respectively.

During operation of the machine and manufacture of sterile packages the packing material web is supplied continuously from a packing material magazine roll, not shown on the drawing. The packing material web 1 is conducted up to the guide roll 2 located in the upper part of the machine, from where the material web 1 is conducted substantially vertically downwards. At some distance below the guide roll 2 the material web passes a shaping element (not shown), which by successive bending of the material web transforms the same to tubular shape. When tubular shape has been completed, the longitudinal edges of the material web are heated to the softening temperature of the thermoplastic layer, whereupon the edges are made to overlap one another and are sealed together with the help of the sealing arrangement 13. During the continued downward movement the tube is filled in its lower part with contents 9, and is sealed at equal distances by repeated pressing flat of transverse zones by means of sealing jaws 4. The separate packages formed by the transverse sealings are separated from one another by cutting through the sealing zones with the help of a cutting arrangement not shown on the drawing. The level of the contents is maintained the whole time at some distance above the place of sealing by continuous supply via the filling pipe 5, which extends from a container for the contents (not shown) through the upper, open end of the tube 3, and substantially parallel with the tube, up to an area somewhat above the sealing jaws 4 where the pipe ends.

For the manufacture of sterile packages in accordance with the invention a sterilizing agent in fluid form is delivered via the pipe 6. The pipe 6 runs parallel with the filling pipe 5 but ends at a higher level than the filling pipe, and more precisely in a dish or container 7 arranged around the filling pipe and open at the top. Directly underneath the container 7 is a tube heater 8, which besides heating the inside of the tube also heats the container 7 to such a temperature that the sterilizing agent delivered through the delivery pipe is evaporated. It has been found appropriate to maintain the temperature of the container somewhat above the boiling point of the sterilizing agent. Since the portion of the tube 3 which is above the container 7 is relatively cold, the vapour formed will condense on the inside of the tube where it forms a uniform layer of condensate containing sterilizing agent. An increased concentration of the proportion of hydrogen peroxide can be observed in that part of the condensate layer which is located above the longitudinal joint of the material tube 3, which may be explained by the fact that here, directly after the sealing arrangement 13, the temperature is higher than in the surrounding tube region, which means that only hydrogen peroxide can condense in this portion of the tube. During the continuous movement downwards of the tube 3, this condensed sterilizing agent will pass the container 7 and enter into the area underneath the container which is heated by means of the tube heater 8. Hereby the inside wall of the tube 3 as well as the sterilizing fluid condensed on the same are heated so strongly, that the agent is evaporated again and rises upwards to the area above the container 7 where it is condensed again on the cold wall of the tube 3. This process is repeated as long as the packing machine is in operation, and the whole time a controlled delivery of sterilizing agent through the pipe 6 takes place to replace the loss which arises owing to a part of the evaporated sterilizing agent escaping through the upper end of the tube without being condensed on the tube wall.

Since it is desirable to prevent residues of the sterilizing agent to follow the tube downwards past the tube heater 8, the sterilizing process described above has to be controlled in a suitable manner. A metering arrangement for this purpose may for example be of the type shown on the drawing, where the delivery pipe 6 for sterilizing agent is provided with a control valve 10, which is actuated by means of a temperature-scanning element 11, which monitors the temperature on the outside of the packing material tube 3 at the level of the tube heater 8. If an insufficient quantity of sterilizing agent is delivered to the container 7, the sterilizing agent present on the wall of the tube 3 will be evaporated quickly, whereupon the heat from the tube heater will strongly heat the tube wall instead, whose temperature will be monitored by means of probes or the element 11, which gives a signal to the control valve, to increase the delivery of sterilizing agent. If, on the other hand, too much sterilizing agent is condensed on the walls of the tube 3, the wall on the level of the scanning element 11 will be relatively cold, since the heat from the tube heater 8 is used to evaporate the condensed layer. The control valve 10 is consequently throttled. Another method to ensure that the sterilizing agent does not follow the tube 3 down into the contents, is to lengthen the tube heater 8 to such an extent that all the sterilizing agent present on the inner wall of the tube is evaporated with certainty. To ensure this, the delivery pipe 6 has to be provided moreover with a control valve, which is adjusted in such a manner that the rate of delivery of sterilizing agent does not become too high. At optimum setting of the valve, the inside of the packing material tube 3, as it approaches the upper end of the tube heater 8, will be covered with a uniform layer of sterilizing agent, which however will be of a thickness not so great as to prevent complete evaporation as the tube 3 approaches the bottom third of the tube heater. This method is simple and uncomplicated, but less accurate, and it involves greater consumption of sterilizing agent than the method described earlier. It is also possible to use a metering pump controlled by the element 11 to provide the delivery of the sterilizing agent.

The container 7 arranged around the delivery pipe 5 for the contents 9 need not have the location as shown on the drawing, that is to say directly above the tube heater 8. The container may be placed substantially anywhere in the vicinity of the tube heater, and even below the tube heater. In the latter placing, however, the container 7 would have to be heated by means of a heating arrangement set up in or around the container, since the heat from the tube heater 8 would not be able sufficiently to heat the container for the sterilizing agent present in the container to be evaporated. However, if the container is placed directly above the tube heater, the heat flowing upwards from the tube heater is more than sufficient for heating the container, and in certain cases it may even be necessary to cool the container. The container or dish 7 is then designed with double walls between which coolant, e.g. water or air can be made to circulate. Pipes for the conducting in and out of coolant are arranged parallel with the delivery pipes 5 and 6 and out through the upper, open end of the tube 3.

The rate of delivery of the sterilizing agent as well as the appropriate container temperature will depend of course on the type of sterilizing agent that is used. A suitable agent is a mixture of water and hydrogen peroxide, the concentration of hydrogen peroxide being between 10 and 35%, preferably though 15%.

To inhibit the sterilizing agent in vapour form from escaping from the upper end of the tube 3, it is appropriate to arrange in the upper end a screen 12 with substantially the same surface and shape as the tube's cross-section. The screen 12 can be fixed to and fitted tightly to the delivery pipes 5,6. To prevent any vapour from condensing on the screen, the screen can possibly be heated to a temperature which exceeds the temperature on the tube's inside.

With the help of the method and the arrangement in accordance with the invention a rapid and simple sterilization of the continuously advancing, tubular packing material is provided. The design of the arrangement is comparatively simple and the consumption of sterilizing agent is appreciably less than in earlier known sterilizing methods. The arrangement moreover eliminates the earlier need for additional stabilizers and wetting agents in the sterilizing medium.

That which is claimed is:

1. A method for the internal sterilization and filling of a tube of packing material comprising the sequential steps of: supplying a tube of packing material to a packaging machine, supplying a sterile product into the tube of material, supplying a liquid sterilizing agent into the tube of material above the sterile product, vaporizing the liquid sterilizing agent, condensing the vaporized liquid sterilizing agent on the inside walls of the tube of material and repeatedly flat pressing and sealing the tube of material to form packages of sterile product.

2. The method of claim 1 wherein the liquid sterilizing agent is vaporized by delivering said agent into a heated container inside the tube of material.

3. The method of claim 2 wherein the supply of liquid sterilizing agent is metered in response to the temperature in the tube adjacent to the level of the sterile product by a thermostatically responsive metering arrangement.

4. Apparatus to produce a packaged sterile product comprising: means to direct a tube of packing material downwardly, a sterile product supply tube projecting downwardly into the tube of material to supply a sterile product into the tube of material, means supplying a liquid sterilizing agent into said tube of material, container means mounted below the sterilizing agent supply means to receive liquid sterilizing agent therefrom, means to vaporize the liquid sterilizing agent in said container means and means to flat press and seal the tube of material adjacent the bottom of the tube of material.

5. The apparatus of claim 4 wherein said means to vaporize includes a radiant heating element below said container means.

6. The apparatus of claim 4 wherein a screen means having substantially the same size and shape of the tube of material is mounted inside the tube of material above said container means to inhibit the escape of said vaporized sterilizing agent from the tube of material.

7. The apparatus of claim 4 wherein the container means surrounds said sterile product supply tube, said means to vaporize being a radiant heating means surrounding said sterile product supply tube below said container means and said liquid sterilizing agent supply means including a metering valve and a temperature sensing means mounted outside the tube of material adjacent said radiant heating means to control the flow of liquid sterilizing agent through said metering valve in response to the temperature in the tube of material adjacent said radiant heating means.

8. The apparatus of claim 4 wherein said means to supply the liquid sterilizing agent includes a metering means and temperature responsive sensing means to control the flow of sterilizing agent into the tube of material responsive to the temperature inside the tube of material.

9. The apparatus of claim 8 wherein said temperature responsive sensing means is located adjacent said vaporizing means outside the tube of material.

* * * * *